US010000834B2

(12) United States Patent
Na et al.

(10) Patent No.: US 10,000,834 B2
(45) Date of Patent: Jun. 19, 2018

(54) BULK NICKEL-CHROMIUM-PHOSPHORUS GLASSES BEARING NIOBIUM AND BORON EXHIBITING HIGH STRENGTH AND/OR HIGH THERMAL STABILITY OF THE SUPERCOOLED LIQUID

(71) Applicant: Glassimetal Technology, Inc., Pasadena, CA (US)

(72) Inventors: Jong Hyun Na, Pasadena, CA (US); Maximilien Launey, Pasadena, CA (US); Danielle Duggins, Garden Grove, CA (US); Oscar Abarca, Anaheim, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 330 days.

(21) Appl. No.: 14/540,815

(22) Filed: Nov. 13, 2014

(65) Prior Publication Data

US 2015/0240336 A1 Aug. 27, 2015

Related U.S. Application Data

(60) Provisional application No. 61/944,197, filed on Feb. 25, 2014.

(51) Int. Cl.
*C22C 45/04* (2006.01)
*C22C 1/00* (2006.01)

(52) U.S. Cl.
CPC ..... *C22C 45/04* (2013.01); *C22C 1/002* (2013.01)

(58) Field of Classification Search
None
See application file for complete search history.

(56) References Cited

U.S. PATENT DOCUMENTS 3,856,513 A 12/1974 Chen et al.
4,116,682 A 9/1978 Polk et al.
(Continued)

FOREIGN PATENT DOCUMENTS

CN 1354274 6/2002
CN 1653200 8/2005
(Continued)

OTHER PUBLICATIONS

Habazaki et al., "Corrosion behaviour of amorphous Ni—Cr—Nb—P—B bulk alloys in 6M HCl solution," *Material Science and Engineering*, A318, 2001, pp. 77-86.
(Continued)

*Primary Examiner* — George Wyszomierski
(74) *Attorney, Agent, or Firm* — Polsinelli PC

(57) ABSTRACT

Ni—Cr—Nb—P—B alloys and metallic glasses are provided, where Nb and B are varied such as to achieve alloys with good glass forming ability that form metallic glasses which may exhibit unexpectedly high strength and/or high thermal stability of the supercooled liquid. Specifically, the alloys of the current disclosure are capable of forming metallic glasses and have critical rod diameters of at least 3 mm, while the metallic glasses exhibit yield strength greater than 2550 MPa and stability of the supercooled liquid of at least 45° C.

13 Claims, 17 Drawing Sheets

(56) References Cited

U.S. PATENT DOCUMENTS

| | | | | |
|---|---|---|---|---|
| 4,126,284 | A | 11/1978 | Ichikawa et al. | |
| 4,144,058 | A | 3/1979 | Chen et al. | |
| 4,152,144 | A | 5/1979 | Hasegawa et al. | |
| 4,385,932 | A | 5/1983 | Inomata et al. | |
| 4,385,944 | A | 5/1983 | Hasegawa | |
| 4,582,536 | A | 4/1986 | Raybould | |
| 4,892,628 | A | 1/1990 | Guilinger | |
| 4,900,638 | A | 2/1990 | Emmerich | |
| 4,968,363 | A | 11/1990 | Hashimoto et al. | |
| 5,338,376 | A | 8/1994 | Liu et al. | |
| 5,429,725 | A | 7/1995 | Thorpe et al. | |
| 5,634,989 | A | 6/1997 | Hashimoto et al. | |
| 6,004,661 | A | 12/1999 | Sakai et al. | |
| 6,303,015 | B1 | 10/2001 | Thorpe et al. | |
| 6,325,868 | B1 | 12/2001 | Kim et al. | |
| 6,695,936 | B2 | 2/2004 | Johnson | |
| 8,052,923 | B2 | 11/2011 | Langlet | |
| 8,287,664 | B2 | 10/2012 | Brunner | |
| 9,085,814 | B2 * | 7/2015 | Na | C22C 1/002 |
| 2005/0263216 | A1 | 12/2005 | Chin et al. | |
| 2006/0213586 | A1 | 9/2006 | Kui | |
| 2007/0175545 | A1 | 8/2007 | Urata et al. | |
| 2009/0110955 | A1 | 4/2009 | Hartman et al. | |
| 2012/0073710 | A1 | 3/2012 | Kim et al. | |
| 2012/0168037 | A1 | 7/2012 | Demetriou et al. | |
| 2013/0048152 | A1 | 2/2013 | Na et al. | |
| 2013/0263973 | A1 | 10/2013 | Kurahashi et al. | |
| 2014/0076467 | A1 | 3/2014 | Na et al. | |
| 2014/0096873 | A1 | 4/2014 | Na et al. | |
| 2014/0116579 | A1 | 5/2014 | Na et al. | |
| 2014/0130942 | A1 | 5/2014 | Floyd et al. | |
| 2014/0130945 | A1 | 5/2014 | Na et al. | |
| 2014/0190593 | A1 | 7/2014 | Na et al. | |
| 2014/0213384 | A1 | 7/2014 | Johnson et al. | |
| 2014/0238551 | A1 | 8/2014 | Na et al. | |
| 2015/0047755 | A1 | 2/2015 | Na et al. | |
| 2015/0158126 | A1 | 6/2015 | Hartmann et al. | |
| 2015/0159242 | A1 | 6/2015 | Na et al. | |
| 2015/0176111 | A1 | 6/2015 | Na et al. | |
| 2015/0197837 | A9 | 7/2015 | Schramm et al. | |
| 2016/0060739 | A1 * | 3/2016 | Na | C22C 1/002 148/555 |

FOREIGN PATENT DOCUMENTS

| | | |
|---|---|---|
| DE | 3929222 | 3/1991 |
| DE | 102011001783 | 10/2012 |
| DE | 102011001784 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63-079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

Park T.G. et al., "Development of new Ni-based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

U.S. Appl. No. 14/458,091, filed Aug. 12, 2014, Na et al.

U.S. Appl. No. 14/501,779, filed Sep. 30, 2014, Na et al.

U.S. Appl. No. 14/565,219, filed Dec. 9, 2013, Na et al.

U.S. Appl. No. 14/581,950, filed Dec. 23, 2014, Na et al.

U.S. Appl. No. 14/824,733, filed Aug. 12, 2015, Na et al.

U.S. Appl. No. 14/797,878, filed Jul. 13, 2015, Na et al.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

* cited by examiner

BULK NICKEL-CHROMIUM-PHOSPHORUS GLASSES BEARING NIOBIUM AND BORON EXHIBITING HIGH STRENGTH AND/OR HIGH THERMAL STABILITY OF THE SUPERCOOLED LIQUID

CROSS-REFERENCE TO RELATED APPLICATIONS

The present application claims the benefit of U.S. Provisional Patent Application No. 61/944,197, entitled "Bulk Nickel-Chromium-Phosphorus Glasses Bearing Niobium and Boron Exhibiting High Strength and/or High Thermal Stability of the Supercooled Liquid", filed on Feb. 25, 2014, which is incorporated herein by reference in its entirety.

TECHNICAL FIELD

The present disclosure relates to Ni—Cr—Nb—P—B alloys bearing Nb and B that are capable of forming metallic glass and have critical rod diameters of at least 3 mm, and wherein the metallic glass demonstrates a high strength and/or high thermal stability of the supercooled liquid.

BACKGROUND

Ni—Cr—Nb—P—B alloys capable of forming bulk metallic glass rods with critical rod diameters of 3 mm or greater have been disclosed in U.S. patent application Ser. No. 13/592,095, entitled "Bulk Nickel-Based Chromium and Phosphorus Bearing Metallic Glasses", filed on Aug. 22, 2012, and Ser. No. 14/067,521, entitled "Bulk Nickel-Based Chromium and Phosphorus Bearing Metallic Glasses with High Toughness", filed on Oct. 30, 2013, the disclosures of which are incorporated herein by reference in their entirety. In these applications, peaks in glass forming ability are identified at a Cr content ranging from 5 to 10 atomic percent, a Nb content ranging from 3 to 3.5 atomic percent, a B content of about 3 atomic percent, and a P content of about 16.5 atomic percent. Bulk metallic glass rods with diameters as large as 11 mm can be formed within those ranges.

The Nb and B atomic concentrations disclosed in those applications range from 1.5 to 4.5 atomic percent, for both Nb and B. Habazaki et al. has presented a Ni—Cr—Nb—P—B composition with a Nb concentration greater than 4.5 atomic percent capable of forming metallic glass rods 1 mm in diameter (H. Habazaki, H. Ukai, K. Izumiya, K. Hashimoto, Materials Science and Engineering A318, 77-86 (2001), the disclosure of which is incorporated herein by reference). However, those authors failed to demonstrate a compositional range at these higher Nb concentrations over which good glass-forming ability can be attained, where metallic glass rods can be formed with diameters of at least 3 mm. Furthermore, these authors failed to identify a compositional range over which good glass-forming ability in conjunction with unexpectedly high strength and/or thermal stability of the supercooled liquid can be attained.

BRIEF SUMMARY

The present disclosure is directed to Ni—Cr—Nb—P—B alloys and metallic glasses of Ni—Cr—Nb—P—B alloys, where Nb and B may be varied such as to achieve alloys with good glass forming ability that form metallic glasses which may exhibit unexpectedly high strength. Specifically, the alloys of the current disclosure are capable of forming metallic glass rods with diameters of at least 3 mm, while the metallic glasses exhibit yield strength greater than 2550 MPa.

In one aspect, the disclosure is directed to an alloy or a metallic glass represented by the following formula (subscripts a, b, c, and d denote atomic percentages):

$$Ni_{(100-a-b-c-d)}Cr_aNb_bP_cB_d \quad \text{Eq. (1)}$$

where:

a ranges from 7 to 11
b ranges from 4.5 to 5.5
c ranges from 13 to 16
d ranges from 4.5 to 5.5.

In some aspects the critical rod diameters of the alloys is at least 3 mm.

In other aspects, a metallic glass formed of the alloy has a yield strength greater than 2550 MPa.

In another embodiment, parameters a, b, and c are determined by the value of parameter d according to the following equations:

$$a=a_1+a_2\cdot d$$

$$b=b_1\cdot d$$

$$c=c_1+c_2\cdot d$$

where:

d ranges from 4.5 to 5.5
$a_1$ ranges from 10.5 to 12.5
$a_2$ ranges from −1.1 to −0.9
$b_1$ ranges from 0.9 to 1.1
$c_1$ ranges from 19 to 20
$c_2$ ranges from −1.1 to −0.9.

In various aspects, the critical rod diameter of the alloys is at least 3 mm.

In other aspects, the alloys are capable of forming metallic glasses having yield strength of at least 2550 MPa.

In other aspects, the alloys are capable of forming metallic glasses having Vickers hardness of at least 742 Kgf/mm$^2$.

The disclosure is also directed to an alloy or a metallic glass having compositions selected from a group consisting of $Ni_{69}Cr_7Nb_{4.5}P_{15}B_{4.5}$, $Ni_{69}Cr_{6.875}Nb_{4.675}P_{14.875}B_{4.675}$, $Ni_{69}Cr_{6.75}Nb_{4.75}P_{14.75}B_{4.75}$, $Ni_{69}Cr_{6.675}Nb_{4.875}P_{14.675}B_{4.875}$, $Ni_{69}C_{6.5}Nb_5P_{14.5}B_5$, $Ni_{69}Cr_{6.375}Nb_{5.125}P_{14.375}B_{5.125}$, $Ni_{69}Cr_{6.25}Nb_{5.25}P_{14.25}B_{5.25}$, and $Ni_{69}Cr_{6.125}Nb_{5.375}P_{14.125}B_{5.375}$.

The present disclosure further provides Ni—Cr—Nb—P—B alloys and metallic glasses, where Nb and B may be varied such as to achieve alloys with good glass forming ability that form metallic glasses which may exhibit unexpectedly high thermal stability of the supercooled liquid. Specifically, the alloys of the current disclosure are capable of forming metallic glass rods with diameters of at least 3 mm, while the supercooled liquid state of the metallic glasses exhibit a thermal stability greater than 45° C.

In another aspect, the disclosure is directed to an alloy or a metallic glass represented by the following formula (subscripts a, b, c, and d denote atomic percentages):

$$Ni_{(100-a-b-c-d)}Cr_aNb_bP_cB_d \quad \text{Eq. (1)}$$

where:

a ranges from 7 to 11
b ranges from 1 to 3.25
c ranges from 13 to 16
d ranges from 3 to 6.5.

In various aspects, the critical rod diameter of the alloy is at least 3 mm.

In other aspects, the supercooled liquid state of the metallic glass has a thermal stability, defined as the difference between $T_x$ and $T_g$ measured at a scan rate of 20° C./min, greater than 45° C.

In another embodiment, parameters a, b, c, and d vary over the following ranges:

a ranges from 7 to 11 b ranges from 1.5 to 3 c ranges from 13 to 16 d ranges from 3.5 to 5.5.

In various aspects, the critical rod diameter of the alloy is at least 5 mm.

In other aspects, the supercooled liquid state of the metallic glass has a thermal stability, defined as the difference between $T_x$ and $T_g$ measured at a scan rate of 20° C./min, of at least 50° C.

In another embodiment, parameters a, b, and c are determined by the value of parameter d according to the following equations:

$$a=a_1+a_2\cdot d$$

$$b=b_1+b_2\cdot d$$

$$c=c_1+c_2\cdot d$$

where d ranges from 3 to 6.5

$a_1$ ranges from 6 to 8

$a_2$ ranges from 0.3 to 0.55

$b_1$ ranges from 4 to 5

$b_2$ ranges from −0.55 to −0.3

$c_1$ ranges from 19 to 20

$c_2$ ranges from −1.1 to −0.9.

In various aspects, the critical rod diameter of the alloy at least 3 mm. In other aspects, the supercooled liquid state of the metallic glass has a thermal stability, defined as the difference between $T_x$ and $T_g$ measured at a scan rate of 20° C./min, of at least 45° C.

In another embodiment, parameters a, b, and c are determined by the value of parameter d according to the following equations:

$$a=a_1+a_2\cdot d$$

$$b=b_1+b_2\cdot d$$

$$c=c_1+c_2\cdot d$$

where d ranges from 3.5 to 5.5

$a_1$ ranges from 6 to 8

$a_2$ ranges from 0.45 to 0.55

$b_1$ ranges from 4 to 5

$b_2$ ranges from −0.55 to −0.45

$c_1$ ranges from 19 to 20

$c_2$ ranges from −1.1 to −0.9.

In various aspects, the critical rod diameter of the alloy is at least 5 mm. In other aspects, the supercooled liquid state of the metallic glass has a thermal stability, defined as the difference between $T_x$ and $T_g$ measured at a scan rate of 20° C./min, of at least 50° C.

In some embodiments, the notch toughness of the metallic glass is at least 55 MPa $m^{1/2}$.

In some embodiments, the notch toughness of the metallic glass is at least 70 MPa $m^{1/2}$.

The disclosure is also directed to an alloy or a metallic glass having compositions selected from a group consisting of $Ni_{69}Cr_{8.5}Nb_3P_{16.5}B_3$, $Ni_{69}Cr_{8.75}Nb_{2.75}P_{16}B_{3.5}$, $Ni_{69}Cr_9Nb_{2.5}P_{15.5}B_4$, $Ni_{69}Cr_{9.25}Nb_{2.25}P_{15}B_{4.5}$, $Ni_{69}Cr_{9.5}Nb_2P_{14.5}B_5$, $Ni_{69}Cr_{9.75}Nb_{1.75}P_{14}B_{5.5}$, $Ni_{69}Cr_7Nb_{4.5}P_{15}B_{4.5}$, and $Ni_{69}Cr_{10.25}Nb_{1.25}P_{13}B_{6.5}$.

In some embodiments, up to 1 atomic percent of P in the alloys may be substituted by at least one of Si and Sn.

In other embodiments, up to 30 atomic percent of Ni in the alloys may be substituted by Co.

In other embodiments, up to 10 atomic percent of Ni in the alloys may be substituted by Fe.

In yet other embodiments, up to 5 atomic percent of Ni in the alloys may be substituted by Cu.

The disclosure is further directed to a metallic glass having any of the above formulas and/or formed of any of the foregoing alloys.

In further embodiments, a method is provided for forming an article of a metallic glass comprising an alloy according to the present disclosure having a lateral dimension of at least 3 mm. The method includes melting the alloy and subsequently quenching the molten alloy at a cooling rate sufficiently high to prevent crystallization of the alloy.

Additional embodiments and features are set forth in part in the description that follows, and in part will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DESCRIPTION

Figure 1:
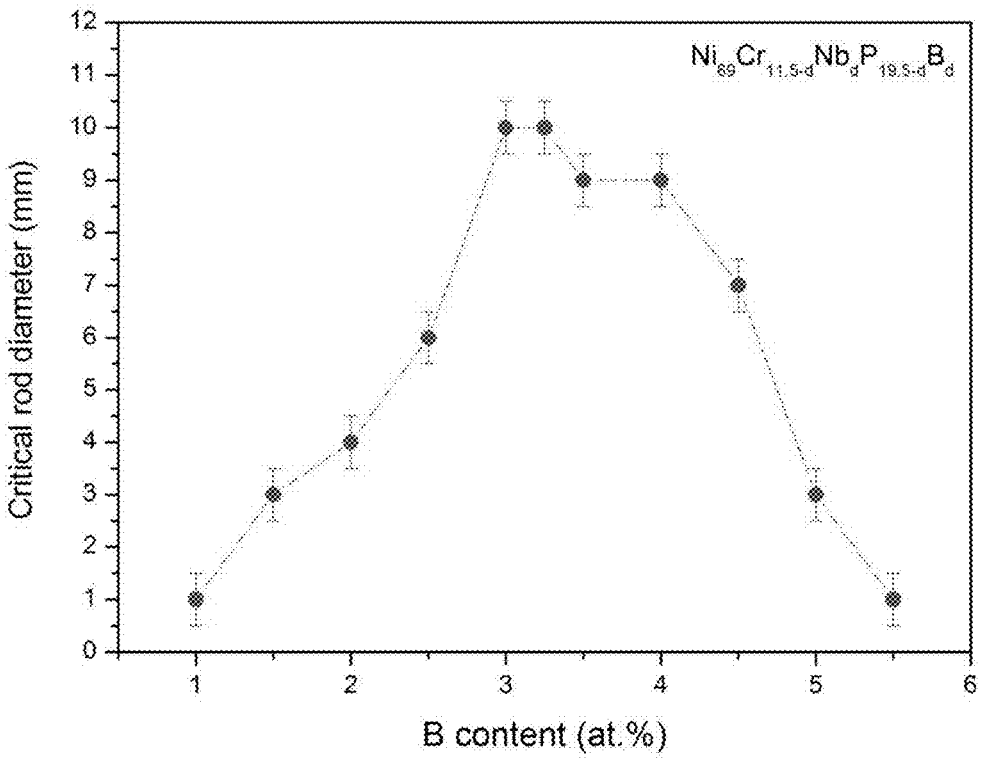
FIG. 1 provides a data plot showing the effect of varying the B atomic percent d on the critical rod diameter of $Ni_{69}Cr_{11.5-d}Nb_dP_{19.5-d}B_d$ alloys, in accordance with embodiments of the present disclosure.

The present disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses formed of the disclosed alloys described herein.

Definitions

In the present disclosure, the glass-forming ability of each alloy is quantified by the "critical rod diameter," defined as maximum rod diameter in which the amorphous phase can be formed when processed by a method of water quenching a quartz tube with a 0.5 mm thick wall containing a molten alloy.

A "critical cooling rate", which is defined as the cooling rate to avoid crystallization and form the amorphous phase of the alloy (i.e. a metallic glass), and which determines the critical rod diameter. The lower the critical cooling rate of an alloy, the larger its critical rod diameter. The critical cooling rate $R_c$ in K/s and critical rod diameter $d_c$ in mm are related via the following approximate empirical formula:

$$R_c = 1000/d_c^2 \quad \text{Eq. (2)}$$

For example, according to Eq. (2), the critical cooling rate for an alloy having a critical rod diameter of about 3 mm is only about $10^2$ K/s.

Generally, three categories are known in the art for identifying the ability of an alloy to form a metallic glass (i.e. to bypass the stable crystal phase and form an amorphous phase). Alloys having critical cooling rates in excess of $10^{12}$ K/s are typically referred to as non-glass formers, as it is very difficult to achieve such cooling rates and form the amorphous phase over a meaningful thickness of bulk metallic glass (i.e. at least 1 micrometer). Alloys having critical cooling rates in the range of $10^5$ to $10^{12}$ K/s are typically referred to as marginal glass formers, as they are able to form glass over thicknesses ranging from 1 to 100 micrometers according to Eq. (2). Alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of an alloy is, to a very large extent, dependent on the composition of the alloy. The compositional ranges for alloys capable of forming marginal glass formers are considerably broader than those for forming bulk glass formers.

The thermal stability of the supercooled liquid $\Delta T$ is defined as the difference between the crystallization temperature $T_x$ and the glass transition temperature $T_g$ of the metallic glass, $\Delta T = T_x - T_g$, measured at heating rate of 20 K/min. A large $\Delta T$ value designates an ability of the metallic glass to be formed into an article by thermoplastic processing methods at temperatures above $T_g$.

The notch toughness, defined as the stress intensity factor at crack initiation $K_q$, is the measure of the material's ability to resist fracture in the presence of a notch. The notch toughness is a measure of the work required to propagate a crack originating from a notch. A high $K_q$ ensures that the material will be tough in the presence of defects.

The yield strength is defined as the stress at which the material yields plastically. The compressive yield strength, $\sigma_y$, is a measure of the material's ability to resist non-elastic yielding under compression. A high $\sigma_y$ ensures that the material will be strong.

Hardness is a measure of the material's ability to resist plastic indentation. A high hardness will ensure that the material will be resistant to indentation and scratching. Vickers Hardness is a widely adopted measure of the hardness of a material.

Description of Alloy and Metallic Glass Compositions

In accordance with the provided disclosure and drawings, Ni—Cr—Nb—P—B alloys are capable of forming metallic glasses. The alloys, described herein, allow for bulk metallic glass formation such that metallic glasses having critical rod diameters of at least 3 mm can be formed.

Ni—Cr—Nb—P—B alloys that fall within the compositional ranges of the present disclosure having a critical rod diameter of at least 3 mm and as large as 10 mm or larger can be represented by the following formula (subscripts denote atomic percentages):

$$Ni_{(100-a-b-c-d)}Cr_aNb_bP_cB_d \quad \text{Eq. (1)}$$

In some embodiments, parameters a, b, and c are determined by the value of parameter d according to the following equations:

$$a=a_1+a_2\cdot d$$

$$b=b_1\cdot d$$

$$c=c_1+c_2\cdot d$$

where d ranges from 1.5 to 5.5

$a_1$ ranges from 10.5 to 12.5

$a_2$ ranges from −1.1 to −0.9

$b_1$ ranges from 0.9 to 1.1

$c_1$ ranges from 19 to 20

$c_2$ ranges from −1.1 to −0.9 and wherein the critical rod diameters of the alloy is at least 3 mm.

Specific embodiments of metallic glasses formed of alloys within the above range having compositions according to the formula $Ni_{69}Cr_{11.5-d}Nb_dP_{19.5-d}B_d$ are presented in Table 1. The critical rod diameters for sample alloys are also listed in Table 1. Samples 2-9 are disclosed in the previous U.S. patent application Ser. No. 13/592,095. The critical rod diameter is shown to vary gradually from 1 mm to 10 mm and back to 1 mm as the concentration of B d ranges from 1 to 5.5 atomic percent.

TABLE 1

Sample amorphous alloys according to $Ni_{69}Cr_{11.5-d}Nb_dP_{19.5-d}B_d$ formula, and associated critical rod diameter

| Sample | Composition | Critical Rod Diameter [mm] |
|---|---|---|
| 1 | $Ni_{69}Cr_{10.5}Nb_1P_{18.5}B_1$ | 1 |
| 2 | $Ni_{69}Cr_{10}Nb_{1.5}P_{18}B_{1.5}$ | 3 |
| 3 | $Ni_{69}Cr_{9.5}Nb_2P_{17.5}B_2$ | 4 |
| 4 | $Ni_{69}Cr_9Nb_{2.5}P_{17}B_{2.5}$ | 6 |
| 5 | $Ni_{69}Cr_{8.5}Nb_3P_{16.5}B_3$ | 10 |
| 6 | $Ni_{69}Cr_{8.25}Nb_{3.25}P_{16.25}B_{3.25}$ | 10 |
| 7 | $Ni_{69}Cr_8Nb_{3.5}P_{16}B_{3.5}$ | 9 |
| 8 | $Ni_{69}Cr_{7.5}Nb_4P_{15.5}B_4$ | 9 |
| 9 | $Ni_{69}Cr_7Nb_{4.5}P_{15}B_{4.5}$ | 7 |
| 10 | $Ni_{69}Cr_{6.5}Nb_5P_{14.5}B_5$ | 3 |
| 11 | $Ni_{69}Cr_6Nb_{5.5}P_{14}B_{5.5}$ | 1 |

Figure 2:
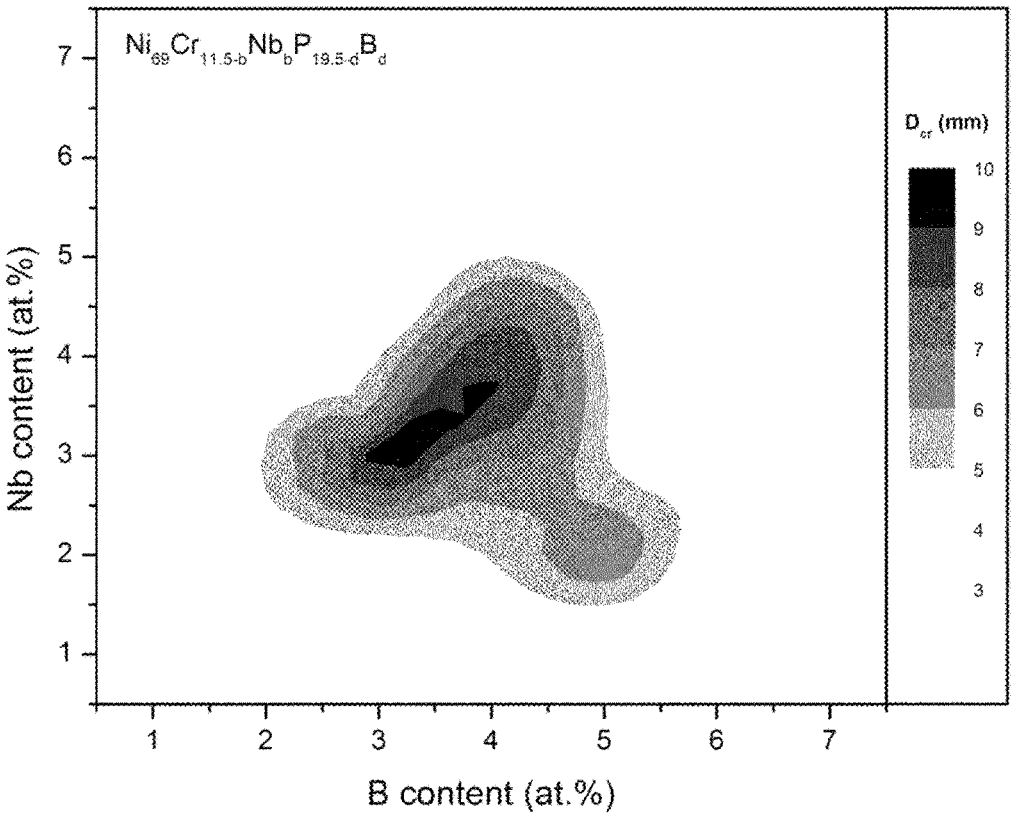
FIG. 2 provides a contour plot in which the critical rod diameter is plotted against the Nb and B change, whereas the sum of Cr and Nb is maintained at 11.5 atomic percent while the sum of P and B is maintained at 19.5 atomic percent, in accordance with embodiments of the present disclosure.

FIG. 1 provides a data plot showing the effect of varying the B atomic percent d on the critical rod diameter of $Ni_{69}Cr_{11.5-d}Nb_dP_{19.5-d}B_d$ alloys. FIG. 2 is a contour plot in which the critical rod diameter is plotted against the Nb and B change, where the sum of Cr and Nb is maintained at 11.5 atomic percent while the sum of P and B is maintained at 19.5 atomic percent.

Figure 3:
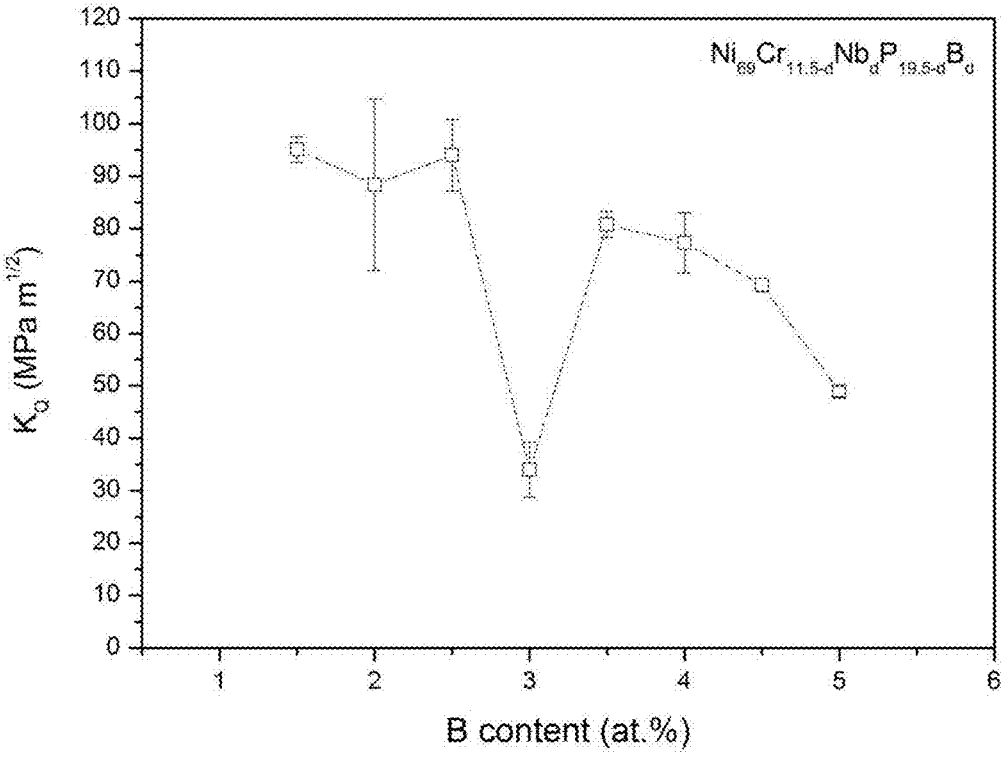
FIG. 3 provides a data plot showing the effect of varying the B atomic percent d on the notch toughness of $Ni_{69}Cr_{11.5-d}Nb_dP_{19.5-d}B_d$ alloys, in accordance with embodiments of the present disclosure.
Figure 4:
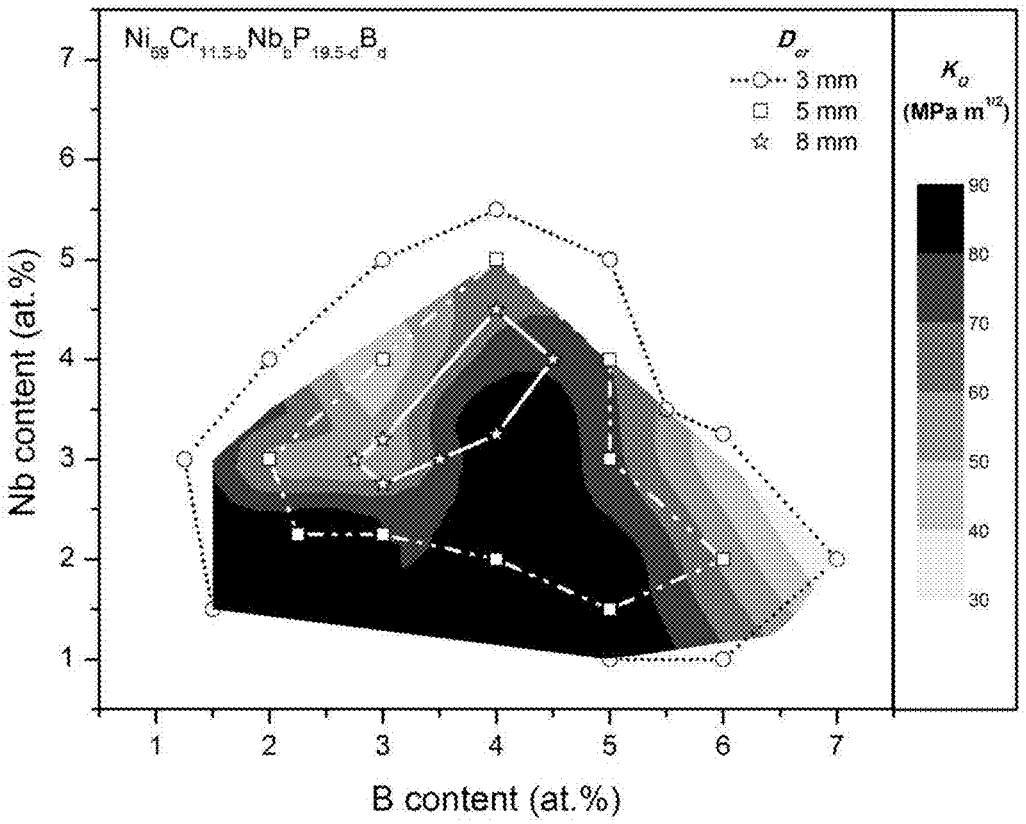
FIG. 4 provides a contour plot in which the notch toughness is plotted against the Nb and B change, whereas the sum of Cr and Nb is maintained at 11.5 atomic percent while the sum of P and B is maintained at 19.5 atomic percent, in accordance with embodiments of the present disclosure.

The notch toughness of sample alloys with compositions according to the formula $Ni_{69}Cr_{11.5-d}Nb_dP_{19.5-d}B_d$ are listed in Table 2. FIG. 3 provides data plots showing the effect of varying the atomic concentration of B (i.e. d) on the notch toughness of $Ni_{69}Cr_{11.5-d}Nb_dP_{19.5-d}B_d$ alloys, respectively. FIG. 4 is a contour plot in which the notch toughness is plotted against the Nb and B change, where the sum of Cr and Nb is maintained at 11.5 atomic percent while the sum of P and B is maintained at 19.5 atomic percent. As seen in Table 2 and FIGS. 3 and 4, the notch toughness generally decreases with increasing the concentration of B d, ranging from about 95 to about 50 MPa $m^{1/2}$ as d ranges from 1.5 to 5 atomic percent, with an abrupt drop to about 30 MPa $m^{1/2}$ when d is 3 percent.

TABLE 2

Notch toughness, Vickers hardness, and yield strength of sample amorphous alloys according to $Ni_{69}Cr_{11.5-d}Nb_dP_{19.5-d}B_d$

| Sample | Composition | Notch Toughness $K_Q$ (MPa $m^{1/2}$) | Vickers Hardness (Kgf/mm$^2$) | Yield Strength $\sigma_y$ (MPa) |
|---|---|---|---|---|
| 2 | $Ni_{69}Cr_{10}Nb_{1.5}P_{18}B_{1.5}$ | 95.1 ± 2.4 | 692.7 ± 2.8 | 2074 |
| 3 | $Ni_{69}Cr_{9.5}Nb_2P_{17.5}B_2$ | 88.4 ± 16.3 | 698.4 ± 3.4 | 2290 |
| 4 | $Ni_{69}Cr_9Nb_{2.5}P_{17}B_{2.5}$ | 94 ± 6.8 | 713.0 ± 11.2 | 2223 |
| 5 | $Ni_{69}Cr_{8.5}Nb_3P_{16.5}B_3$ | 34 ± 5.2 | 727.9 ± 12.2 | 2344 |
| 7 | $Ni_{69}Cr_8Nb_{3.5}P_{16}B_{3.5}$ | 80.8 ± 2.5 | 735.1 ± 4.9 | 2460 |
| 8 | $Ni_{69}Cr_{7.5}Nb_4P_{15.5}B_4$ | 77.3 ± 5.7 | 741.9 ± 8.4 | 2435 |
| 9 | $Ni_{69}Cr_7Nb_{4.5}P_{15}B_{4.5}$ | 69.3 ± 1.3 | 743.8 ± 6.9 | 2582 |
| 10 | $Ni_{69}Cr_{6.5}Nb_5P_{14.5}B_5$ | 48.9 ± 1.0 | 744.0 ± 12.3 | 2677 |

Figure 5:
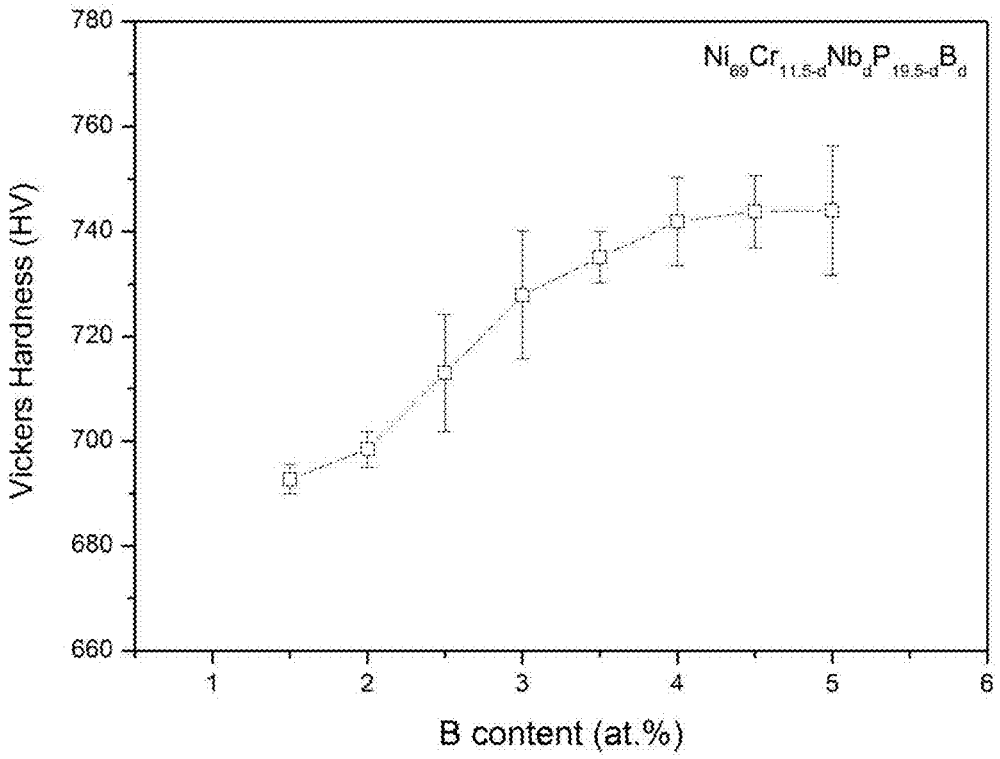
FIG. 5 provides a data plot showing the effect of varying the B atomic percent d on the hardness of $Ni_{69}Cr_{11.5-d}Nb_dP_{19.5-d}B_d$ alloys, in accordance with embodiments of the present disclosure.

The Vickers hardness of sample alloys with compositions according to the formula $Ni_{69}Cr_{11.5-d}Nb_dP_{19.5-d}B_d$ is listed in Table 2. FIG. 5 provides data plots showing the effect of varying the B atomic concentration don the Vickers hardness of $Ni_{69}Cr_{11.5-d}Nb_dP_{19.5-d}B_d$ alloys, respectively. As seen in Table 2 and FIG. 5, the hardness increases monotonically with increasing the B atomic concentration d, ranging from about 690 to about 745 Kgf/mm$^2$ as d ranges from 1.5 to 5 percent.

Figure 6:
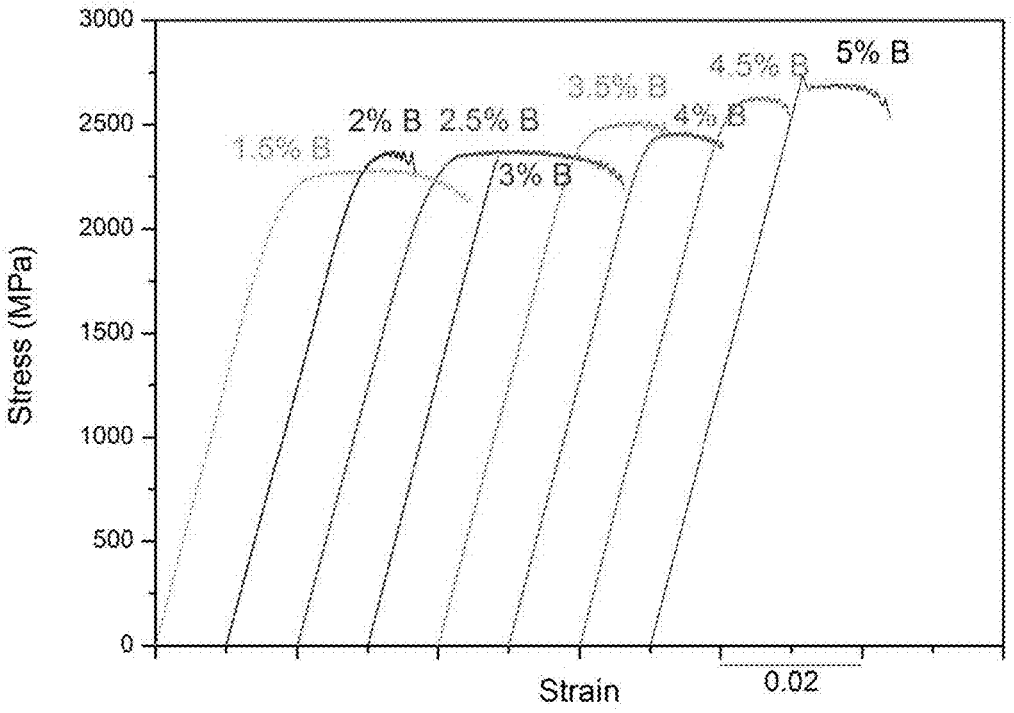
FIG. 6 provides compressive stress-strain diagrams for sample metallic glasses $Ni_{69}Cr_{11.5-d}Nb_dP_{19.5-d}B_d$, in accordance with embodiments of the present disclosure.
Figure 7:
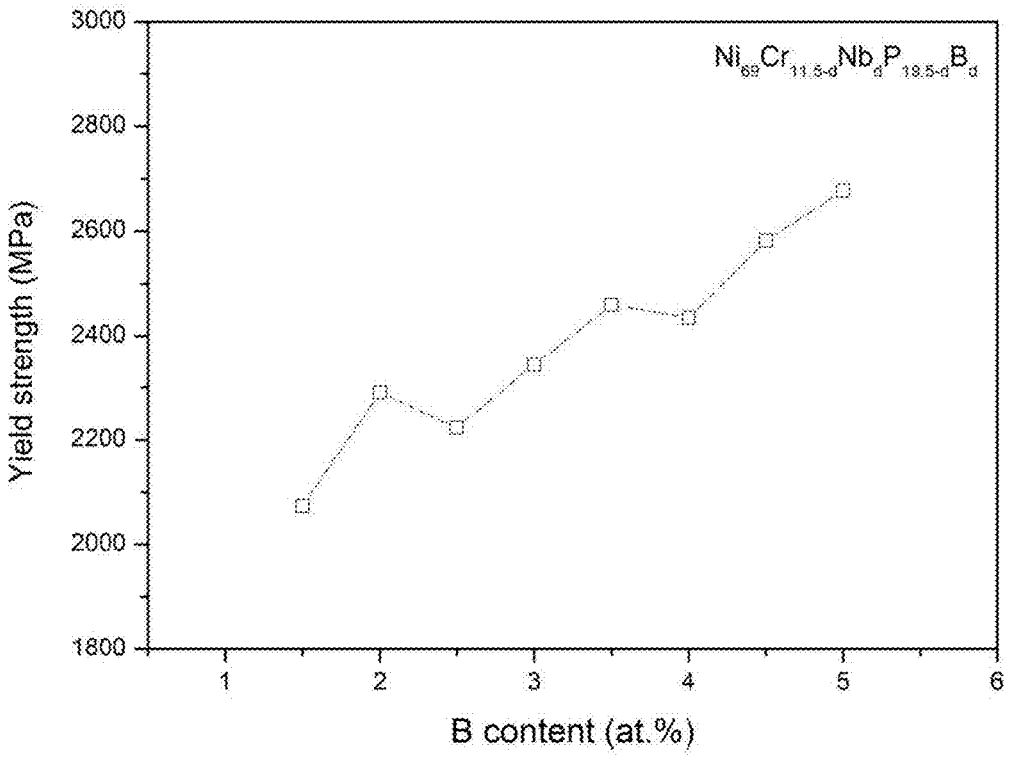
FIG. 7 provides a data plot showing the effect of varying the B atomic percent d on the yield strength of $Ni_{69}Cr_{11.5-d}Nb_dP_{19.5-d}B_d$ alloys, in accordance with embodiments of the present disclosure.
Figure 8:
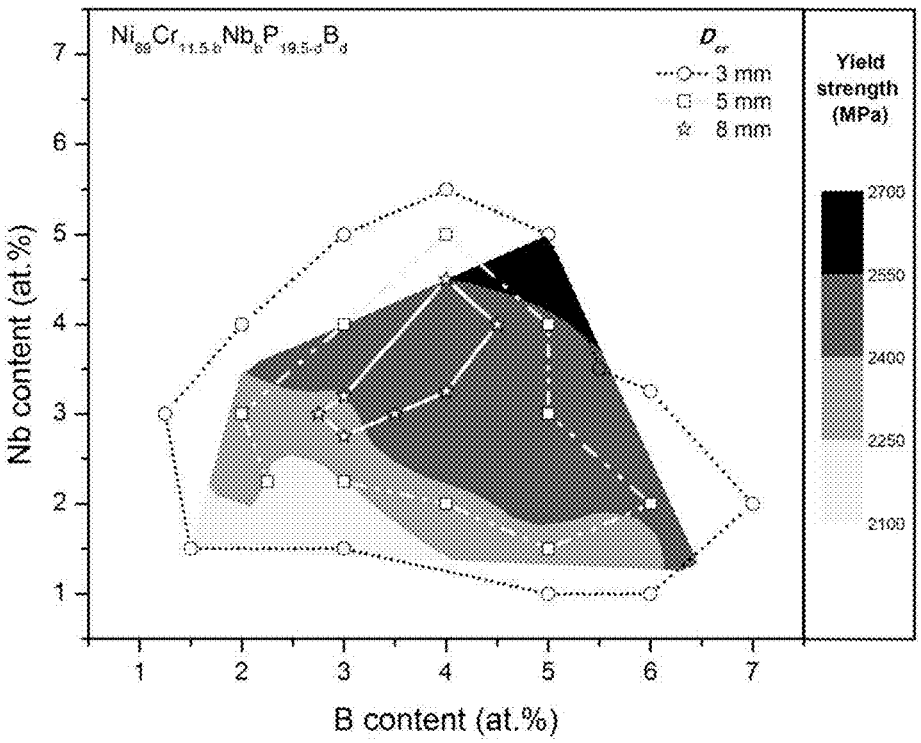
FIG. 8 provides a contour plot in which the yield strength is plotted against the Nb and B change, whereas the sum of Cr and Nb is maintained at 11.5 atomic percent while the sum of P and B is maintained at 19.5 atomic percent, in accordance with embodiments of the present disclosure.

FIG. 6 provides compressive stress-strain diagrams for sample metallic glasses $Ni_{69}Cr_{11.5-d}Nb_dP_{19.5-d}B_d$ in accordance with embodiments of the present disclosure. The yield strength of metallic glasses with compositions according to the formula $Ni_{69}Cr_{11.5-d}Nb_dP_{19.5-d}B_d$ are listed in Table 2. FIG. 7 provides data plots showing the effect of varying the atomic concentration of B (i.e. d) on the yield strength of sample $Ni_{69}Cr_{11.5-d}Nb_dP_{19.5-d}B_d$ metallic glasses, respectively. FIG. 8 is a contour plot in which the yield strength is plotted against the Nb and B change, where the sum of Cr and Nb is maintained at 11.5 atomic percent while the sum of P and B is maintained at 19.5 atomic percent.

As seen in Table 2 and FIGS. 6-8, the yield strength increases with increasing the atomic concentration of B, d, ranging from just over 2000 MPa to almost 2700 MPa as d ranges from 1.5 to 5 percent. Specifically, when d ranges between 1.5 and 4 atomic percent, the yield strength overall increases but the increase is non-monotonic, as it can go up as well as down with increasing d. For d greater than 4 percent, and specifically for d greater than 4.5 percent, the yield strength shows a dramatic and consistent increase, exceeding 2550 MPa and reaching values as high as almost 2700 MPa. Such increases in yield strength for d greater than 4.5 percent is highly unexpected.

The yield strengths of the metallic glasses disclosed in U.S. patent application Ser. No. 13/592,095 range from about 2200 MPa to about 2525 MPa. The $Ni_{69}Cr_{11.5-d}Nb_dP_{19.5-d}B_d$ alloys of the present disclosure have yield strength that unexpectedly and significantly exceeds the largest value disclosed in U.S. patent application Ser. No. 13/592,095. As shown in Table 2 and FIGS. 6-8, when d is greater than about 4.5 percent, the yield strength unexpectedly increases beyond 2550 MPa and can be as high as 2700 MPa or higher. Therefore, alloys according to the present disclosure having atomic concentrations of Nb and B greater than about 4.5 and as high as 5.5 percent, exhibit a critical rod diameter of at least 3 mm and demonstrate a yield strength greater than 2550 MPa.

In some embodiments, the disclosure is directed to alloys or metallic glasses represented by Eq. 1, where parameters a, b, c, and d vary over the following ranges:

a ranges from 7 to 11
b ranges from 4.5 to 5.5
c ranges from 13 to 16
d ranges from 4.5 to 5.5.

In various aspects, the critical rod diameter of the alloys is at least 3 mm. In other aspects, the metallic glasses demonstrate a yield strength of greater than 2550 MPa.

In other embodiments, the disclosure is directed to alloys or metallic glasses represented by Eq. 1, where parameters a, b, and c are determined by the value of parameter d according to the following equations:

$$a=a_1+a_2\cdot d$$

$$b=b_1\cdot d$$

$$c=c_1+c_2\cdot d$$

where
d ranges from 4.5 to 5.5
$a_1$ ranges from 10.5 to 12.5
$a_2$ ranges from −1.1 to −0.9
$b_1$ ranges from to 0.9 to 1.1
$c_1$ ranges from 19 to 20
$c_2$ ranges from −1.1 to −0.9.

The critical rod diameter of the alloys or metallic glasses is at least 3 mm. The metallic glasses can also have a yield strength of at least 2550 MPa.

In addition to the alloys listed in Tables 1 and 2, other alloys, in accordance with the current disclosure, that may exhibit a critical rod diameter of at least 3 mm and form metallic glasses that may demonstrate a yield strength greater than 2550 MPa include, but are not limited to, of $Ni_{69}Cr_7Nb_{4.5}P_{15}B_{4.5}$, $Ni_{69}Cr_{6.875}Nb_{4.675}P_{14.875}B_{4.675}$, $Ni_{69}Cr_{6.75}Nb_{4.75}P_{14.75}B_{4.75}$, $Ni_{69}Cr_{6.675}Nb_{4.875}P_{14.675}B_{4.875}$, $Ni_{69}C_{6.5}Nb_5P_{14.5}B_5$, $Ni_{69}Cr_{6.375}Nb_{5.125}P_{14.375}B_{5.125}$, $Ni_{69}Cr_{6.25}Nb_{5.25}P_{14.25}B_{5.25}$, and $Ni_{69}Cr_{6.125}Nb_{5.375}P_{14.125}B_{5.375}$.

In some embodiments, up to 1 atomic percent of P in the alloys according to the current disclosure may be substituted by Si and Sn.

Figure 9:
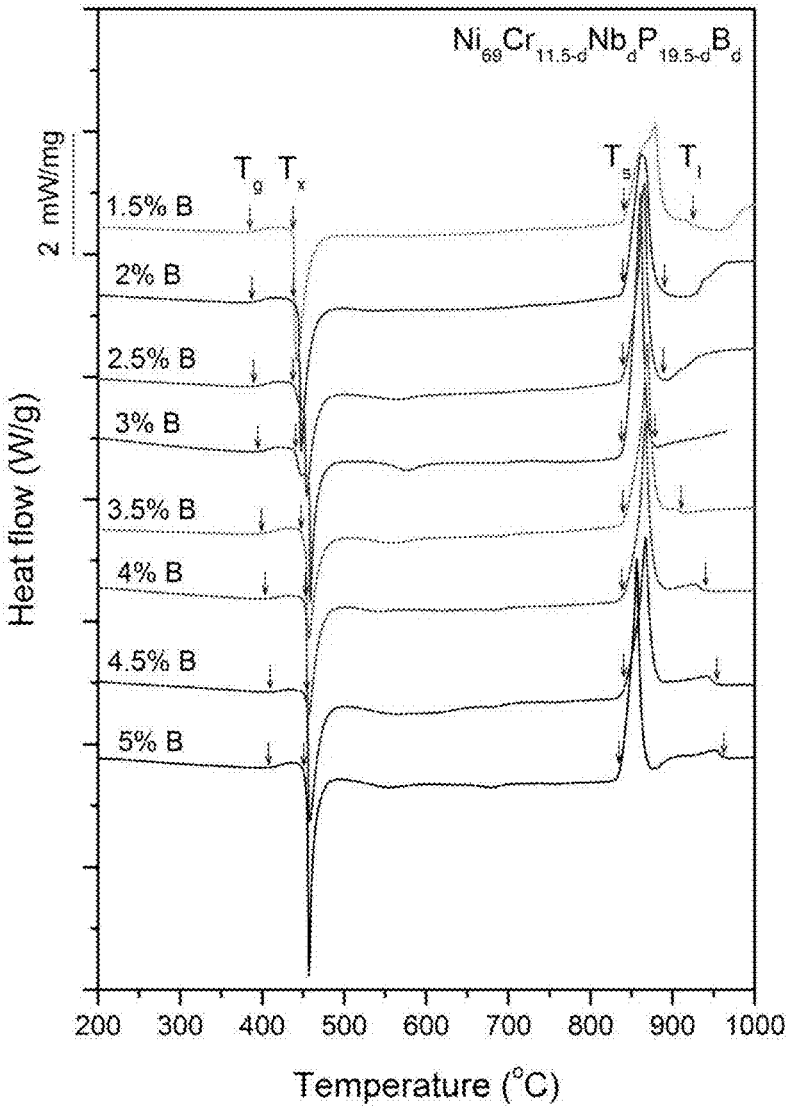
FIG. 9 provides calorimetry scans for sample metallic glasses $Ni_{69}Cr_{11.5-d}Nb_dP_{19.5-d}B_d$ in accordance with embodiments of the present disclosure. The glass transition temperature $T_g$, crystallization temperature $T_x$, solidus temperature $T_s$, and liquidus temperature $T_l$ are indicated by arrows.
Figure 10:
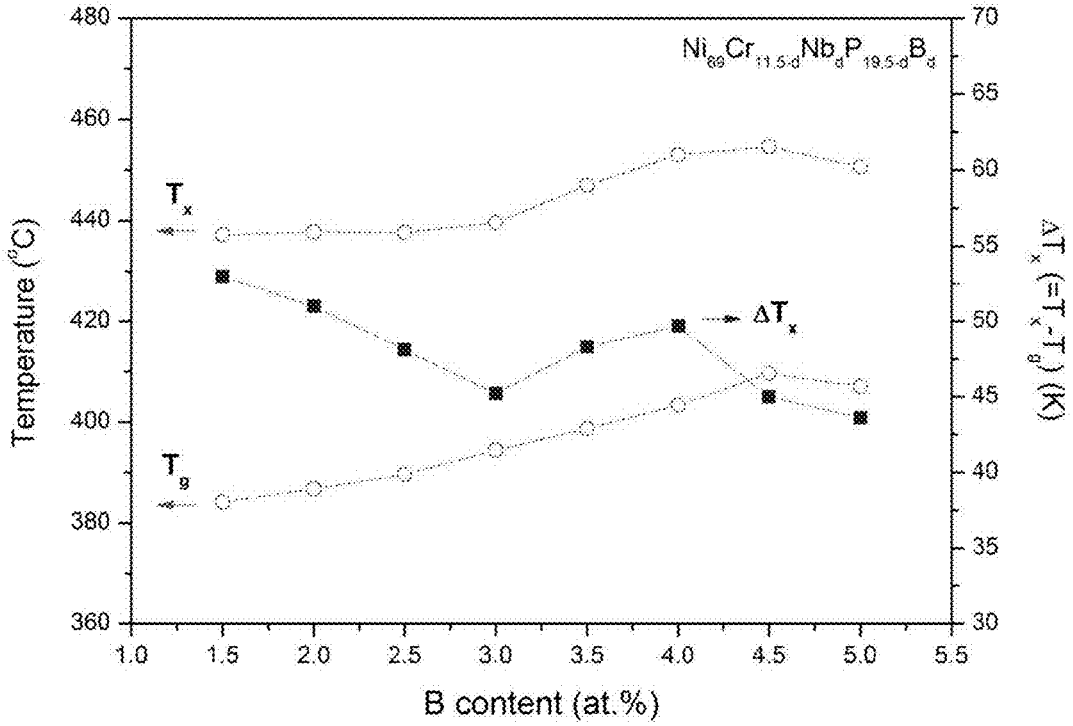
FIG. 10 provides a data plot showing the effect of varying the B atomic percent d on the glass transition temperature $T_g$, crystallization temperature $T_x$, and difference $\Delta T_x = T_x - T_g$ of $Ni_{69}Cr_{11.5-d}Nb_dP_{19.5-d}B_d$ metallic glasses, in accordance with embodiments of the present disclosure, for $1.5 \leq x \leq 5$.
Figure 11:
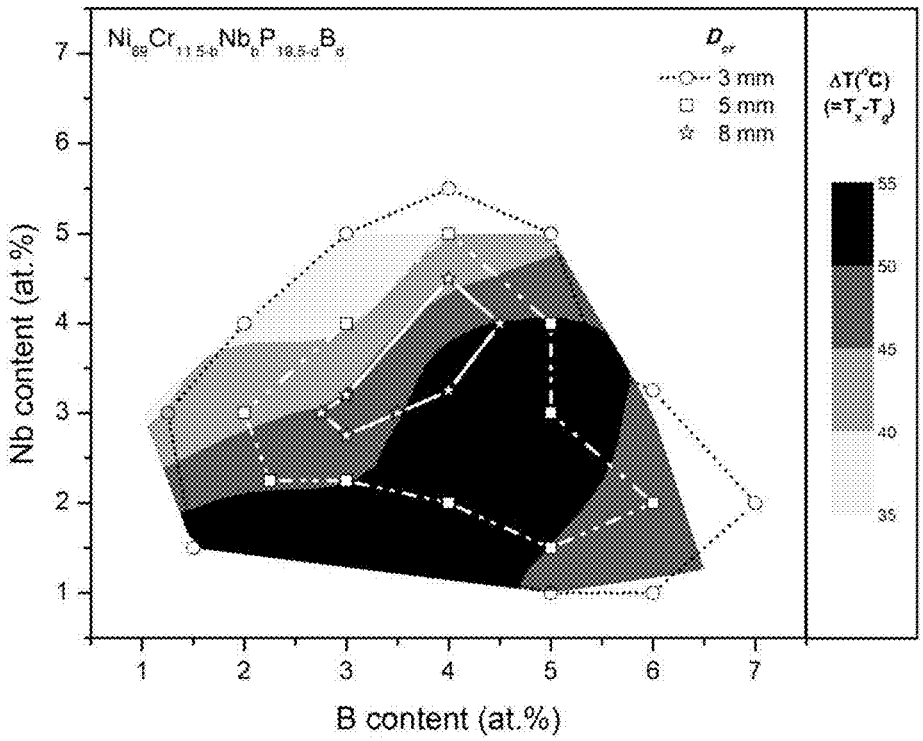
FIG. 11 provides a contour plot in which $\Delta T_x$ is plotted against the Nb and B change, whereas the sum of Cr and Nb is maintained at 11.5 atomic percent while the sum of P and B is maintained at 19.5 atomic percent, in accordance with embodiments of the present disclosure.

FIG. 9 provides calorimetric scans for sample metallic glasses $Ni_{69}Cr_{11.5-d}Nb_dP_{19.5-d}B_d$ in accordance with embodiments of the present disclosure. Arrows from left to right designate the glass transition temperature $T_g$, crystallization temperature $T_x$, solidus temperature $T_s$, and liquidus temperature $T_l$, respectively in FIG. 9. The glass transition temperature $T_g$, crystallization temperature $T_x$, and difference $\Delta T_x=T_x-T_g$ of $Ni_{69}Cr_{11.5-d}Nb_dP_{19.5-d}B_d$ metallic glasses for $1.5\leq d\leq 5$ are listed in Table 3. FIG. 10 provides a data plot showing the effect of varying the B atomic percent on the glass transition temperature $T_g$, crystallization temperature $T_x$, and difference $\Delta T_x=T_x-T_g$ of $Ni_{69}Cr_{11.5-d}Nb_dP_{19.5-d}B_d$ metallic glasses for $1.5\leq d\leq 5$. FIG. 11 is a contour plot in which $\Delta T_x$ is plotted against the Nb and B change, where the sum of Cr and Nb is maintained at 11.5 atomic percent while the sum of P and B is maintained at 19.5 atomic percent.

TABLE 3

Glass-transition temperature $T_g$, crystallization temperature $T_x$, and difference between crystallization and glass transition temperatures $\Delta T_x$ (=$T_x$ − $T_g$) of sample amorphous alloys according to $Ni_{69}Cr_{11.5-d}Nb_dP_{19.5-d}B_d$

| Sample | Composition | $T_g$(° C.) | $T_x$(° C.) | $\Delta T_x$(° C.) |
|---|---|---|---|---|
| 2 | $Ni_{69}Cr_{10}Nb_{1.5}P_{18}B_{1.5}$ | 384.2 | 437.2 | 53 |
| 3 | $Ni_{69}Cr_{9.5}Nb_2P_{17.5}B_2$ | 386.8 | 437.8 | 51 |
| 4 | $Ni_{69}Cr_9Nb_{2.5}P_{17}B_{2.5}$ | 389.6 | 437.7 | 48.1 |
| 5 | $Ni_{69}Cr_{8.5}Nb_3P_{16.5}B_3$ | 394.4 | 439.6 | 45.2 |
| 7 | $Ni_{69}Cr_8Nb_{3.5}P_{16}B_{3.5}$ | 398.7 | 447 | 48.3 |
| 8 | $Ni_{69}Cr_{7.5}Nb_4P_{15.5}B_4$ | 403.3 | 453 | 49.7 |
| 9 | $Ni_{69}Cr_7Nb_{4.5}P_{15}B_{4.5}$ | 409.6 | 454.6 | 45 |
| 10 | $Ni_{69}Cr_{6.5}Nb_5P_{14.5}B_5$ | 407.0 | 450.6 | 43.6 |

In other embodiments, parameters a, b, c, and d vary over the following ranges:
a ranges from 7 to 11
b ranges from 1 to 4
c ranges from 13 to 16
d ranges from 2 to 6.5.

The critical rod diameter of the alloys is at least 3 mm.

Specific embodiments of metallic glasses formed from alloys within the above range having compositions according to the formula $Ni_{69}Cr_{7+0.5d}Nb_{4.5-0.5d}P_{19.5-d}B_d$ are presented in Table 4. The critical rod diameters of sample alloys are also listed in Table 4. Samples 12-17 are disclosed in U.S. patent application Ser. No. 13/592,095. The critical rod diameter is shown to increase from 4 mm to 10 mm as the atomic concentration of B, d, ranges from 2 to 3. The critical rod diameter is also shown to range between 6 mm and 7 mm as d ranges from 3 to 5 percent, and the critical rod diameter gradually decrease from 7 mm to 3 mm as d ranges from 5 to 6.5.

TABLE 4

Sample amorphous alloys according to $Ni_{69}Cr_{7+0.5d}Nb_{4.5-0.5d}P_{19.5-d}B_d$ formula, and associated critical rod diameter

| Sample | Composition | Critical Rod Diameter [mm] |
|---|---|---|
| 12 | $Ni_{69}Cr_8Nb_{3.5}P_{17.5}B_2$ | 4 |
| 13 | $Ni_{69}Cr_{8.25}Nb_{3.25}P_{17}B_{2.5}$ | 7 |
| 14 | $Ni_{69}Cr_{8.5}Nb_3P_{16.5}B_3$ | 10 |
| 15 | $Ni_{69}Cr_{8.75}Nb_{2.75}P_{16}B_{3.5}$ | 7 |
| 16 | $Ni_{69}Cr_9Nb_{2.5}P_{15.5}B_4$ | 6 |
| 17 | $Ni_{69}Cr_{9.25}Nb_{2.25}P_{15}B_{4.5}$ | 6 |
| 18 | $Ni_{69}Cr_{9.5}Nb_2P_{14.5}B_5$ | 7 |
| 19 | $Ni_{69}Cr_{9.75}Nb_{1.75}P_{14}B_{5.5}$ | 5 |
| 20 | $Ni_{69}Cr_{10}Nb_{1.5}P_{13.5}B_6$ | 4 |
| 21 | $Ni_{69}Cr_{10.25}Nb_{1.25}P_{13}B_{6.5}$ | 4 |

Figure 12:
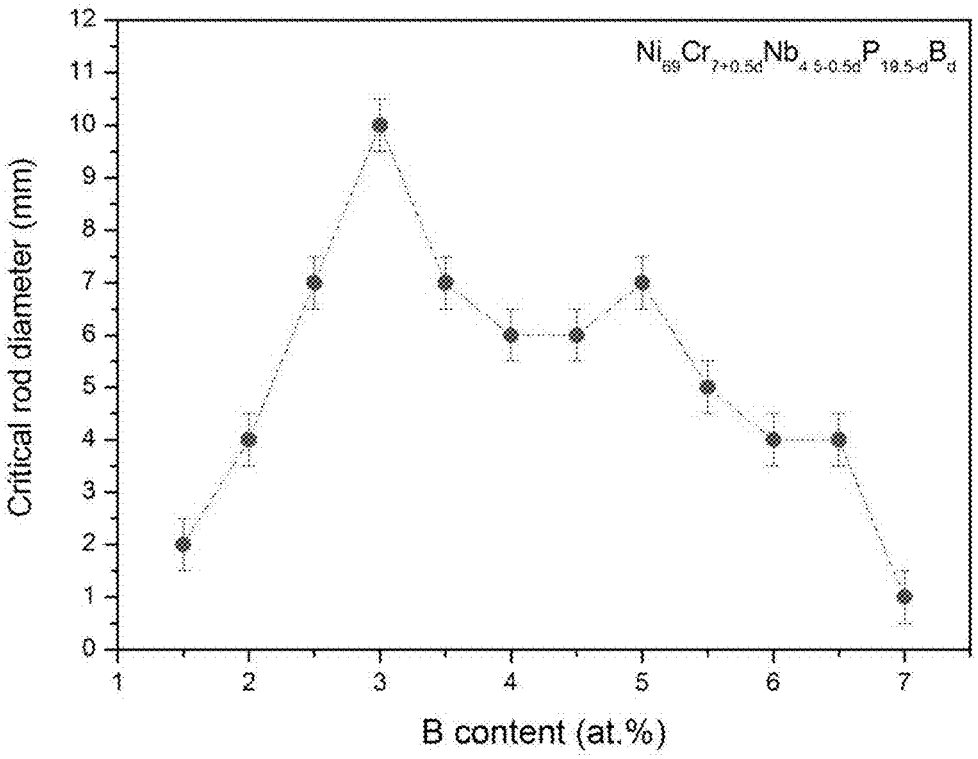
FIG. 12 provides a data plot showing the effect of varying the B atomic percent d on the critical rod diameter of $Ni_{69}Cr_{7+0.5d}Nb_{4.5-0.5d}P_{19.5-d}B_d$ alloys, in accordance with embodiments of the present disclosure.

FIG. 12 provides a data plot showing the effect of varying the atomic concentration of B (i.e. d) on the critical rod diameter of $Ni_{69}Cr_{7+0.5d}Nb_{4.5-0.5d}P_{19.5-d}B_d$ alloys.

Figure 13:
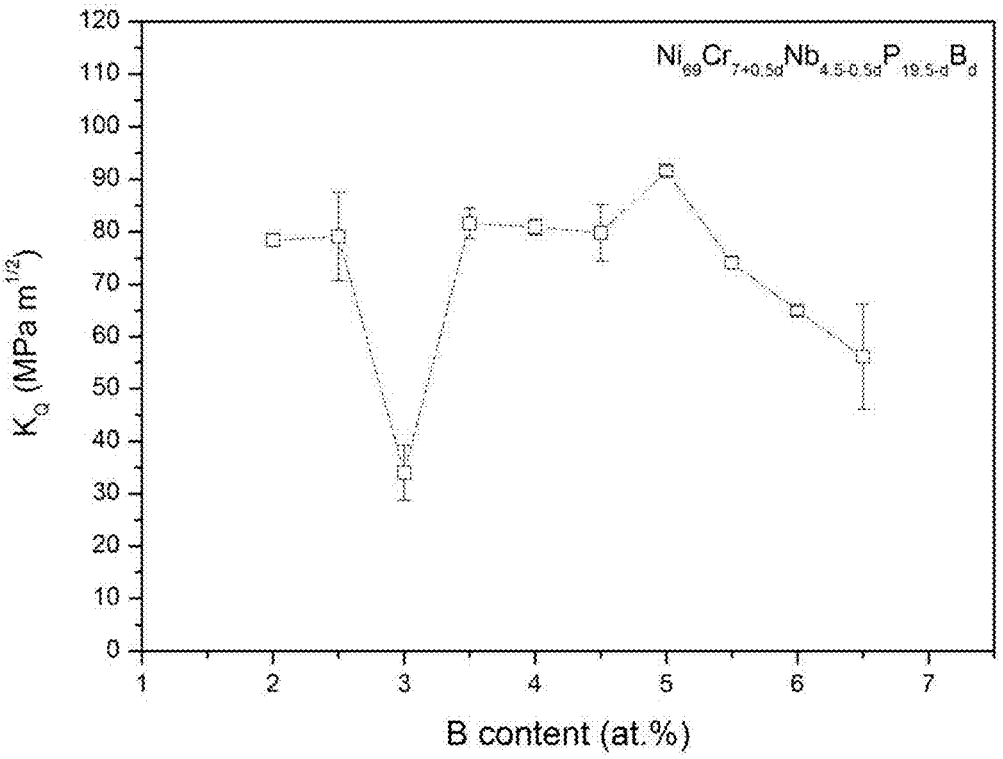
FIG. 13 provides a data plot showing the effect of varying the B atomic percent d on the notch toughness of $Ni_{69}Cr_{7+0.5d}Nb_{4.5-0.5d}P_{19.5-d}B_d$ alloys, in accordance with embodiments of the present disclosure.

The notch toughness of sample alloys with compositions according to the formula $Ni_{69}Cr_{7+0.5d}Nb_{4.5-0.5d}P_{19.5-d}B_d$ are listed in Table 5. FIG. 13 provides data plots showing the effect of varying the atomic concentration of B, d, on the notch toughness of $Ni_{69}Cr_{7+0.5d}Nb_{4.5-0.5d}P_{19.5-d}B_d$ alloys, respectively.

Figure 15:
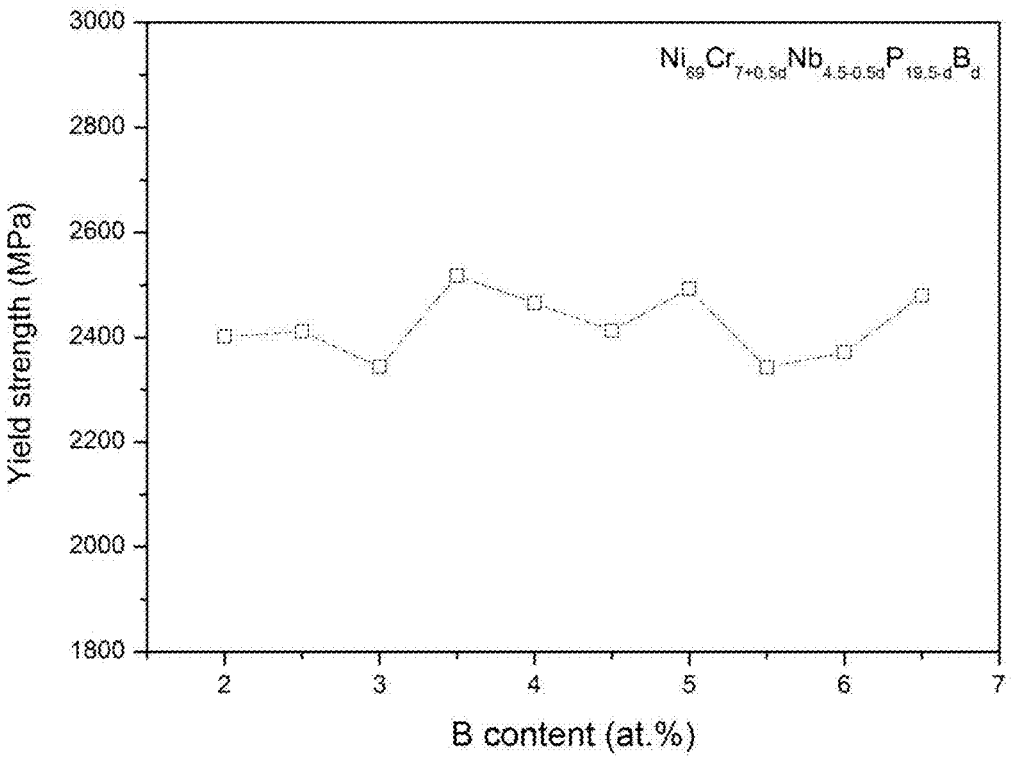
FIG. 15 provides a data plot showing the effect of varying the B atomic percent don the yield strength of $Ni_{69}Cr_{7+0.5d}Nb_{4.5-0.5d}P_{19.5-d}B_d$ alloys, in accordance with embodiments of the present disclosure.

As seen in Table 5 and FIG. 15, the notch toughness generally remains constant at about 80 MPa $m^{1/2}$ when the atomic concentration of B, d, ranges between 2 and 4.5 percent, with an abrupt drop to about 30 MPa $M^{1/2}$. When d ranges between 4.75 and 5.25 percent, or is at about 5, the notch toughness unexpectedly increases to over 90 MPa $m^{1/2}$. When d increases beyond 5.25 percent the notch toughness gradually decreases reaching a value of about 56 MPa $m^{1/2}$ when d is 6.5 percent.

TABLE 5

Notch toughness and yield strength of sample amorphous alloys according to $Ni_{69}Cr_{7+0.5d}Nb_{4.5-0.5d}P_{19.5-d}B_d$

| Sample | Composition | Notch Toughness $K_Q$ (MPa $m^{1/2}$) | Yield Strength $\sigma_y$ (MPa) |
|---|---|---|---|
| 12 | $Ni_{69}Cr_8Nb_{3.5}P_{17.5}B_2$ | 78.4 ± 1.2 | 2402 |
| 13 | $Ni_{69}Cr_{8.25}Nb_{3.25}P_{17}B_{2.5}$ | 79.1 ± 8.4 | 2412 |
| 14 | $Ni_{69}Cr_{8.5}Nb_3P_{16.5}B_3$ | 34 ± 5.2 | 2344 |
| 15 | $Ni_{69}Cr_{8.75}Nb_{2.75}P_{16}B_{3.5}$ | 81.6 ± 2.9 | 2518 |
| 16 | $Ni_{69}Cr_9Nb_{2.5}P_{15.5}B_4$ | 80.9 ± 1.5 | 2466 |
| 17 | $Ni_{69}Cr_{9.25}Nb_{2.25}P_{15}B_{4.5}$ | 79.8 ± 5.4 | 2413 |
| 18 | $Ni_{69}Cr_{9.5}Nb_2P_{14.5}B_5$ | 91.6 ± 0.9 | 2493 |
| 19 | $Ni_{69}Cr_{9.75}Nb_{1.75}P_{14}B_{5.5}$ | 74.1 ± 1.1 | 2342 |
| 20 | $Ni_{69}Cr_{10}Nb_{1.5}P_{13.5}B_6$ | 65 ± 0.9 | 2372 |
| 21 | $Ni_{69}Cr_{10.25}Nb_{1.25}P_{13}B_{6.5}$ | 56.2 ± 10.1 | 2480 |

Figure 14:
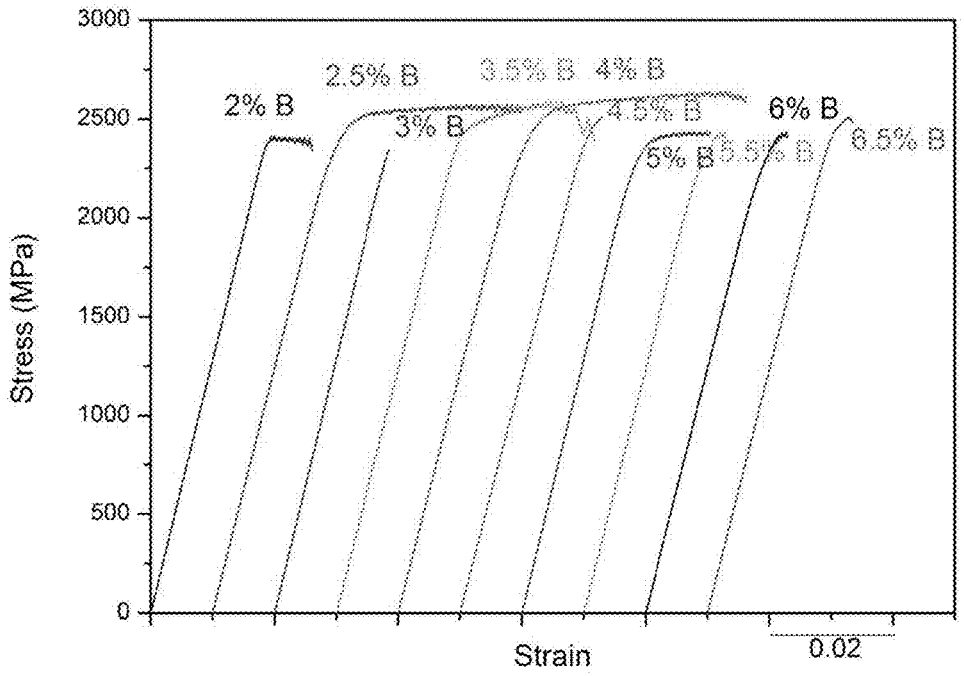
FIG. 14 provides compressive stress-strain diagrams for sample metallic glasses $Ni_{69}Cr_{7+0.5d}Nb_{4.5-0.5d}P_{19.5-d}B_d$, in accordance with embodiments of the present disclosure.

FIG. 14 provides compressive stress-strain diagrams for sample metallic glasses $Ni_{69}Cr_{7+0.5d}Nb_{4.5-0.5d}P_{19.5-d}B_d$ in accordance with embodiments of the present disclosure. The yield strength of sample metallic glasses with compositions according to the formula $Ni_{69}Cr_{7+0.5d}Nb_{4.5-0.5d}P_{19.5-d}B_d$ are listed in Table 5. FIG. 15 provides data plots showing the effect of varying the atomic concentration of B (i.e. d) on the yield strength of $Ni_{69}Cr_{7+0.5d}Nb_{4.5-0.5d}P_{19.5-d}B_d$ metallic glasses, respectively. As seen in Table 5 and FIGS. 8, 14 and 15, the yield strength fluctuates between about 2300 MPa and 2500 MPa as d ranges from 1.5 to 5 percent.

TABLE 6

Glass-transition temperature $T_g$, crystallization temperature $T_x$, and difference between crystallization and glass transition temperatures $\Delta T_x$ (=$T_x - T_g$) of sample amorphous alloys according to $Ni_{69}Cr_{7+0.5d}Nb_{4.5-0.5d}P_{19.5-d}B_d$

| Sample | Composition | $T_g$ (° C.) | $T_x$ (° C.) | $\Delta T_x$ (° C.) |
|---|---|---|---|---|
| 12 | $Ni_{69}Cr_8Nb_{3.5}P_{17.5}B_2$ | 393.8 | 437.5 | 43.7 |
| 13 | $Ni_{69}Cr_{8.25}Nb_{3.25}P_{17}B_{2.5}$ | 396.1 | 440.8 | 44.7 |
| 14 | $Ni_{69}Cr_{8.5}Nb_3P_{16.5}B_3$ | 394.4 | 439.6 | 45.2 |
| 15 | $Ni_{69}Cr_{8.75}Nb_{2.75}P_{16}B_{3.5}$ | 394.3 | 445.7 | 51.3 |
| 16 | $Ni_{69}Cr_9Nb_{2.5}P_{15.5}B_4$ | 390.1 | 444.3 | 54.2 |
| 17 | $Ni_{69}Cr_{9.25}Nb_{2.25}P_{15}B_{4.5}$ | 391.1 | 443.9 | 52.7 |
| 18 | $Ni_{69}Cr_{9.5}Nb_2P_{14.5}B_5$ | 389.8 | 441.2 | 51.4 |
| 19 | $Ni_{69}Cr_{9.75}Nb_{1.75}P_{14}B_{5.5}$ | 391.0 | 439.3 | 48.3 |
| 20 | $Ni_{69}Cr_{10}Nb_{1.5}P_{13.5}B_6$ | 391.5 | 438.7 | 47.2 |
| 21 | $Ni_{69}Cr_{10.25}Nb_{1.25}P_{13}B_{6.5}$ | 386.7 | 434.1 | 47.4 |

Figure 16:
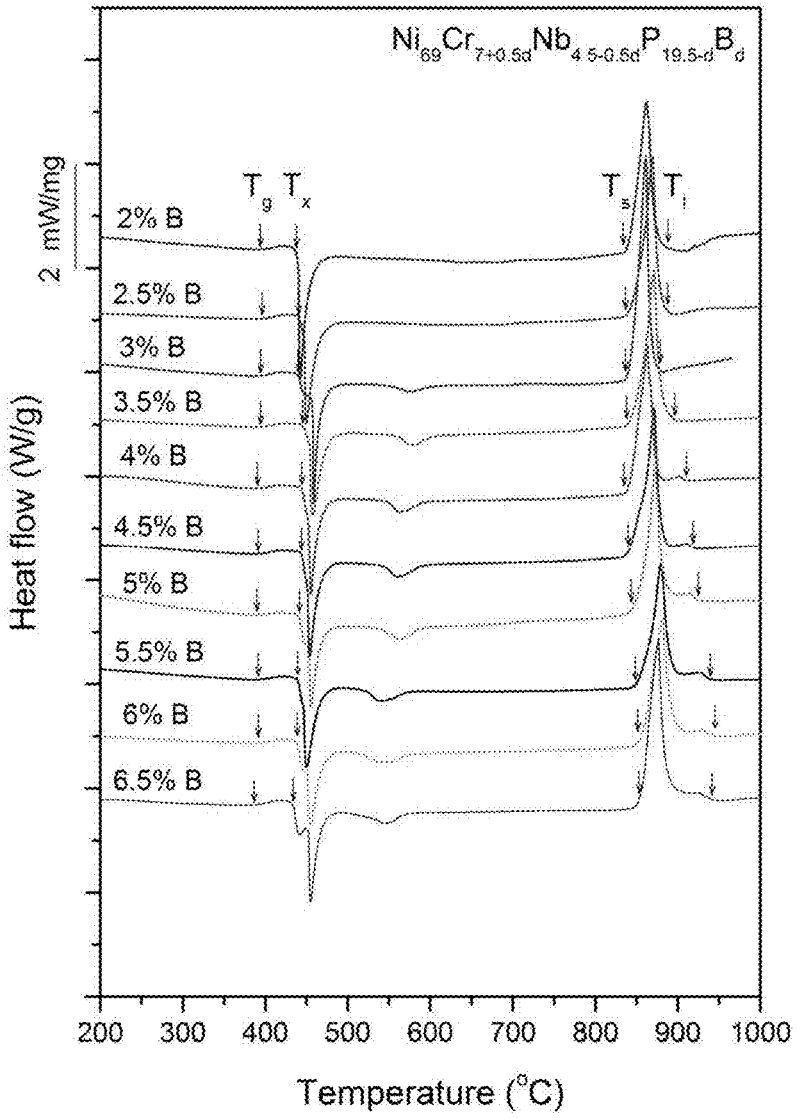
FIG. 16 provides calorimetry scans for sample metallic glasses $Ni_{69}Cr_{7+0.5d}Nb_{4.5-0.5d}P_{19.5-d}B_d$, in accordance with embodiments of the present disclosure. The glass transition temperature $T_g$, crystallization temperature $T_x$, solidus temperature $T_s$, and liquidus temperature $T_l$ are indicated by arrows.
Figure 17:
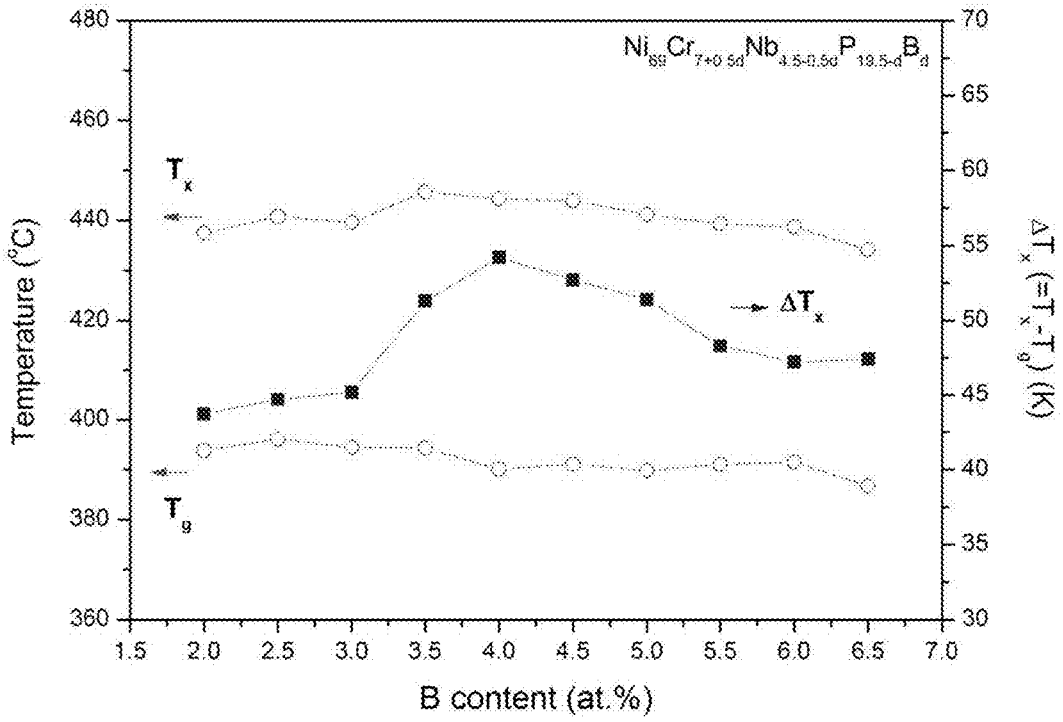
FIG. 17 provides a data plot showing the effect of varying the B atomic percent don the glass transition temperature $T_g$, crystallization temperature $T_x$, and difference $\Delta T_l = T_x - T_g$ of $Ni_{69}Cr_{7+0.5d}Nb_{4.5-0.5d}P_{19.5-d}B_d$ metallic glasses, in accordance with embodiments of the present disclosure, for 2 5×5 6.5.

FIG. 16 provides calorimetry scans for sample metallic glasses $Ni_{69}Cr_{7+0.5d}Nb_{4.5-0.5d}P_{19.5-d}B_d$ in accordance with embodiments of the present disclosure. Arrows from left to right designate the glass transition temperature $T_g$, crystallization temperature $T_x$, solidus temperature $T_s$, and liquidus temperature $T_l$, respectively in FIG. 16. The glass transition temperature $T_g$, crystallization temperature $T_x$, and difference $\Delta T_x = T_x - T_g$ of $Ni_{69}Cr_{7+0.5d}Nb_{4.5-0.5d}P_{19.5-d}B_d$ metallic glasses for $2 \le d \le 6.5$ are listed in Table 6. FIG. 17 provides a data plot showing the effect of varying the B atomic percent on the glass transition temperature $T_g$, crystallization temperature $T_x$, and difference $\Delta T_x = T_x - T_g$ of $Ni_{69}Cr_{7+0.5d}Nb_{4.5-0.5d}P_{19.5-d}B_d$ metallic glasses for $2 \le d \le 6.5$.

As shown in Table 6 and FIGS. 11, 16 and 17, $\Delta T_x$ is maintained below 45° C. when the Nb atomic concentration b is greater than about 3.25 percent and the B atomic concentration d is less than about 3 percent. For b smaller than 3.25 and d larger than 3, $\Delta T_x$ unexpectedly increases higher than 45° C., reaching a peak of 54° C. when b is 2.5 percent and d is 4 percent, and then gradually decreases back to 45° C. when b is 1.25 percent and d is 6.5 percent. Therefore, some alloys in accordance with the present disclosure have a critical rod diameter of at least 3 mm and a $\Delta T_x$ greater than 45° C.

In some embodiments, in accordance with the present disclosure, alloys or metallic glasses can be represented by Eq. 1, where parameters a, b, c, and d vary over the following ranges:

a ranges from 7 to 11
b ranges from 1 to 3.25
c ranges from 13 to 16
d ranges from 3 to 6.5.

The critical rod diameter of the alloys or metallic glasses is at least 3 mm. The metallic glasses can also have a supercooled liquid state with a thermal stability greater than 45° C.

In other embodiments, alloys or metallic glasses are represented by Eq. 1, where parameters a, b, c, and d vary over the following ranges:

a ranges from 7 to 11
b ranges from 1.5 to 3
c ranges from 13 to 16
d ranges from 3.5 to 5.5.

The critical rod diameter of the alloys or metallic glasses is at least 5 mm. The metallic glasses can also have a supercooled liquid state with a thermal stability greater than 50° C.

In other embodiments, alloys or metallic glasses are represented by Eq. 1, where parameters a, b, and c are determined by the value of parameter d according to the following equations:

$$a = a_1 + a_2 \cdot d$$

$$b = b_1 + b_2 \cdot d$$

$$c = c_1 + c_2 \cdot d$$

where d ranges from 3 to 6.5
$a_1$ ranges from 6 to 8
$a_2$ ranges from 0.3 to 0.55
$b_1$ ranges from 4 to 5
$b_2$ ranges from −0.55 to −0.3
$c_1$ ranges from 19 to 20
$c_2$ ranges from −1.1 to −0.9.

The critical rod diameter of the alloys or metallic glasses is at least 3 mm. The metallic glasses also exhibit a supercooled liquid state with a thermal stability greater than 45° C.

In other embodiments, alloys or metallic glasses are represented by Eq. 1, where parameters a, b, and c are determined by the value of parameter d according to the following equations:

$$a = a_1 + a_2 \cdot d$$

$$b = b_1 + b_2 \cdot d$$

$$c = c_1 + c_2 \cdot d$$

where d ranges from 3.5 to 5.5
$a_1$ ranges from 6 to 8
$a_2$ ranges from 0.45 to 0.55
$b_1$ ranges from 4 to 5
$b_2$ ranges from −0.55 to −0.45

$c_1$ ranges from 19 to 20

$c_2$ ranges from −1.1 to −0.9.

The alloys or metallic glasses have critical rod diameters of at least 5 mm. The metallic glasses also exhibit supercooled liquid states with thermal stability greater than 50° C.

In some embodiments, up to 1 atomic percent of P in the alloys according to the current disclosure may be substituted by Si and Sn.

In further embodiments, a metallic glass may comprise any alloy described herein.

Description of Methods of Processing the Sample Alloys

A method for producing the alloy ingots involves inductive melting of the appropriate amounts of elemental constituents in a quartz tube under inert atmosphere. The purity levels of the constituent elements were as follows: Ni 99.995%, Cr 99.996%, Nb 99.95%, P 99.9999%, and B 99.5%. The melting crucible may alternatively be a ceramic such as alumina or zirconia, graphite, sintered crystalline silica, or a water-cooled hearth made of copper or silver.

A particular method for producing metallic glass rods from the alloy ingots for the sample alloys of Tables 1 and 2 involves re-melting the alloy ingots in quartz tubes having 0.5-mm thick walls in a furnace at 1100° C. or higher, and particularly between, 1150° C. to 1400° C., under high purity argon and rapidly quenching in a room-temperature water bath. Alternatively, the bath could be ice water or oil. Metallic glass articles can be alternatively formed by injecting or pouring the molten alloy into a metal mold. The mold can be made of copper, brass, or steel, among other materials.

In some embodiments, prior to producing a metallic glass article, the alloyed ingots may be fluxed with a reducing agent by re-melting the ingots in a quartz tube under inert atmosphere, bringing the alloy melt in contact with the molten reducing agent, and allowing the two melts to interact for about 1000 s at a temperature of about 1200° C. or higher, and subsequently water quenching. In one embodiment, the reducing agent is boron oxide.

Test Methodology for Assessing Glass-Forming Ability

The glass-forming ability of each alloy was assessed by determining the maximum rod diameter in which the amorphous phase of the alloy (i.e. the metallic glass phase) could be formed when processed by the methods described above. X-ray diffraction with Cu-Kα radiation was performed to verify the amorphous structure of the alloys.

Test Methodology for Measuring Notch Toughness

The notch toughness of sample metallic glasses was performed on 3-mm diameter rods. The rods were notched using a wire saw with a root radius ranging from 0.10 to 0.13 mm to a depth of approximately half the rod diameter. The notched specimens were placed on a 3-point bending fixture with span of 12.7 mm, and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Compressive Yield Strength

Compression testing of sample metallic glasses was performed on cylindrical specimens 3 mm in diameter and 6 mm in length by applying a monotonically increasing load at a constant cross-head speed of 0.001 mm/s using a screw-driven testing frame. The strain was measured using a linear variable differential transformer. The compressive yield strength was estimated using the 0.2% proof stress criterion.

Test Methodology for Measuring Hardness

The Vickers hardness (HV0.5) of sample metallic glasses was measured using a Vickers microhardness tester. Eight tests were performed where micro-indentions were inserted on a flat and polished cross section of a 3 mm metallic glass rod using a load of 500 g and a duel time of 10 s.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

The combination of good glass forming ability and an unexpectedly high strength and/or an unexpectedly high thermal stability of the supercooled liquid exhibited by the metallic glasses of the present disclosure make the present alloys and metallic glasses excellent candidates for various engineering applications. Among many applications, the disclosed alloys may be used in consumer electronics, dental and medical implants and instruments, luxury goods, and sporting goods applications.

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the present disclosure. The following claims are intended to cover all generic and specific features described herein, as well as all statements of the scope of the present method and system, which, as a matter of language, might be said to fall therebetween.

What is claimed is:

1. An alloy capable of forming a metallic glass represented by the following formula (subscripts a, b, c, and d denote atomic percentages):

$$Ni_{(100-a-b-c-d)}Cr_aNb_bP_cB_d$$

wherein:

a ranges from 7 to 11, b ranges from 4.5 to 5.5, c ranges from 13 to 16, d ranges from 4.5 to 5.5; and wherein the critical rod diameter of the alloy is at least 3 mm.

2. The alloy according to claim 1 wherein the metallic glass has a yield strength greater than 2550 MPa.

3. The alloy according to claim 1 wherein the metallic glass has Vickers hardness of at least 742 Kgf/mm$^2$.

4. The alloy according to claim 1 wherein up to 1 atomic percent of P is substituted by Si, Sn or combinations thereof.

5. A metallic glass comprising an alloy according to claim 1.

6. An alloy capable of forming a metallic glass represented by the following formula (subscripts a, b, c, and d denote atomic percentages):

$$Ni_{(100-a-b-c-d)}Cr_aNb_bP_cB_d$$

wherein a, b, and c are determined according to the following equations:

$$a=a_1+a_2\cdot d$$

$$c=c_1+c_2\cdot d$$

wherein $b=b_1 \cdot d$, d ranges from 4.5 to 5.5, $a_1$ ranges from 10.5 to 12.5, $a_2$ ranges from −1.1 to −0.9, $b_1$ ranges from 0.9 to 1.1, $c_1$ ranges from 19 to 20, $c_2$ ranges from −1.1 to −0.9; or $b=b_1+b_2 \cdot d$, d ranges from 4.5 to 6.5, $a_1$ ranges from 6 to 8, $a_2$ ranges from 0.3 to 0.55, $b_1$ ranges from 4 to 5, $b_2$ ranges from −0.55 to −0.3, $c_1$ ranges from 19 to 20, $c_2$ ranges from −1.1 to −0.9; and wherein the critical rod diameter of the alloy is at least 3 mm.

7. The alloy according to claim 6 wherein d ranges from 4.5 to 6.5, $a_1$ ranges from 6 to 8, $a_2$ ranges from 0.3 to 0.55, $b_1$ ranges from 4 to 5, $b_2$ ranges from −0.55 to −0.3, $c_1$ ranges from 19 to 20, $c_2$ ranges from −1.1 to −0.9; wherein the critical rod diameter of the alloy is at least 3 mm, and wherein the thermal stability of the supercooled liquid of the metallic glass, defined as the difference between $T_x$ and $T_g$ measured at a scan rate of 20° C./min, is at least 45° C.

8. The alloy according to claim 7 wherein up to 1 atomic percent of P is substituted by Si, Sn or combinations thereof.

9. A metallic glass comprising an alloy according to claim 7.

10. The metallic glass of claim 9 wherein the notch toughness is at least 55 MPa $m^{1/2}$.

11. The metallic glass of claim 10 wherein the notch toughness is at least 70 MPa $m^{1/2}$.

12. The alloy according to claim 6 wherein d ranges from 4.5 to 5.5, $a_1$ ranges from 6 to 8, $a_2$ ranges from 0.45 to 0.55, $b_1$ ranges from 4 to 5, $b_2$ ranges from −0.55 to −0.45, $c_1$ ranges from 19 to 20, $c_2$ ranges from −1.1 to −0.9; wherein critical rod diameter of the alloys is at least 5 mm, and wherein the thermal stability of the supercooled liquid of the metallic glass, defined as the difference between $T_x$ and $T_g$ measured at a scan rate of 20° C./min, is at least 50° C.

13. An alloy capable of forming a metallic glass having composition selected from a group consisting of $Ni_{69}Cr_7Nb_{4.5}P_{15}B_{4.5}$, $Ni_{69}Cr_{6.875}Nb_{4.675}P_{14.875}B_{4.675}$, $Ni_{69}Cr_{6.75}Nb_{4.75}P_{14.75}B_{4.75}$, $Ni_{69}Cr_{6.675}Nb_{4.875}P_{14.675}B_{4.875}$, $Ni_{69}C_{6.5}Nb_5P_{14.5}B_5$, $Ni_{69}Cr_{6.375}Nb_{5.125}P_{14.375}B_{5.125}$, $Ni_{69}Cr_{6.25}Nb_{5.25}P_{14.25}B_{5.25}$, $Ni_{69}Cr_{6.125}Nb_{5.375}P_{14.125}B_{5.375}$, $Ni_{69}Cr_{9.5}Nb_2P_{14.5}B_5$, $Ni_{69}Cr_{9.75}Nb_{1.75}P_{14}B_{5.5}$, and $Ni_{69}Cr_{10.25}Nb_{1.25}P_{13}B_{6.5}$.

* * * * *